United States Patent [19]

Outtrim et al.

[11] 4,338,742

[45] Jul. 13, 1982

[54] ARMADILLO TOY

[76] Inventors: John E. Outtrim, I-10 at Magnolia, Channelview, Tex. 77530; Michael P. Stagner, 12738 La Grove La., Houston, Tex. 77015

[21] Appl. No.: 285,965

[22] Filed: Jul. 23, 1981

[51] Int. Cl.[3] ..... A63H 33/26

[52] U.S. Cl. ..... 46/227; 46/116

[58] Field of Search ..... 46/227, 228, 226, 229, 46/232, 264, 123, 124, 119, 116, 117, 202, 206

[56] References Cited

U.S. PATENT DOCUMENTS 2,886,919 5/1959 Glass et al. ..... 46/227

2,957,273 10/1960 Hughes et al. ..... 46/227

FOREIGN PATENT DOCUMENTS 768869 2/1957 United Kingdom ..... 46/228

*Primary Examiner*—Robert Peshock

*Assistant Examiner*—Mickey Yu

*Attorney, Agent, or Firm*—Carl B. Fox, Jr.

[57] ABSTRACT

Toy, called "The Giant Armadillo Radar", having a molded body in the form of an armadillo, and having a rotatable antenna and flashing lights at the upper side of the body, and having a buzzer which sounds when the lights are flashing. The toy is adapted to suggest a radar-equipped armadillo to children, and to serve as a conversation piece to adults in connection with the current advertising program of a well known brewery company in which a giant armadillo is portrayed as having stolen and consumed great quantities of beer.

3 Claims, 2 Drawing Figures

ARMADILLO TOY

BACKGROUND OF THE DISCLOSURE

A brewing company located in the State of Texas, in its advertising campaigns, has made a great play on the armadillo as having a great liking for the product of the brewing company. The armadillo is displayed in advertising, particularly on television, as having stolen and consumed enormous quantities of beer. This advertising has caught the fancy of a considerable number of the general population and armadillos are referred to frequently in conversation. Therefore, the armadillo toy disclosed and claimed herein is for the purpose of providing a toy for children and a conversation piece for adults which may be obtained and used by the population in general.

SUMMARY OF THE INVENTION

The invention presents a toy in the outward form of an armadillo, and which is equipped with flashing lights, an antenna, and a buzzer, designed to be used as a toy or as a conversation piece. Therefore, the armadillo toy is useful for adults as well as for children. The armadillo toy provided according to this invention is called "The Giant Armadillo Radar" toy.

The toy includes a hollow body of molded plastic, or other suitable material, including a long heavy tail at one end and a head at the other end. The main body portion is hollow and is open at its lower side to provide access into its interior cavity. A structure simulating an antenna is carried by the body near the forward end of its upper side. The antenna is adapted to rotate about a vertical shaft. Four blinking lights are disposed in equally spaced circular disposition about the antenna shaft. One or more batteries within the body provide electrical energy for operation of the buzzer and the blinker lights, and of a motor which rotates the antenna. An on-off switch is provided at the body exterior so that the operation of the buzzer, flashing lights and the antenna rotation may be turned "on" and "off".

A principal object of the invention is to provide a toy in the form of an armadillo which is useful for amusement of children and as a conversation piece for adults. A further object of the invention is to provide such a toy which simulates operation of a radar device, especially in the minds of children. Yet another object of the invention is to provide such a toy which is relatively inexpensive, and which is of pleasing appearance.

Other objects and advantages of the invention will appear from the following detailed description thereof, reference being made to the accompanying drawings.

BRIEF DESCRIPTIONS OF THE DRAWINGS

DESCRIPTION OF THE PREFERRED EMBODIMENT

Figure 1:
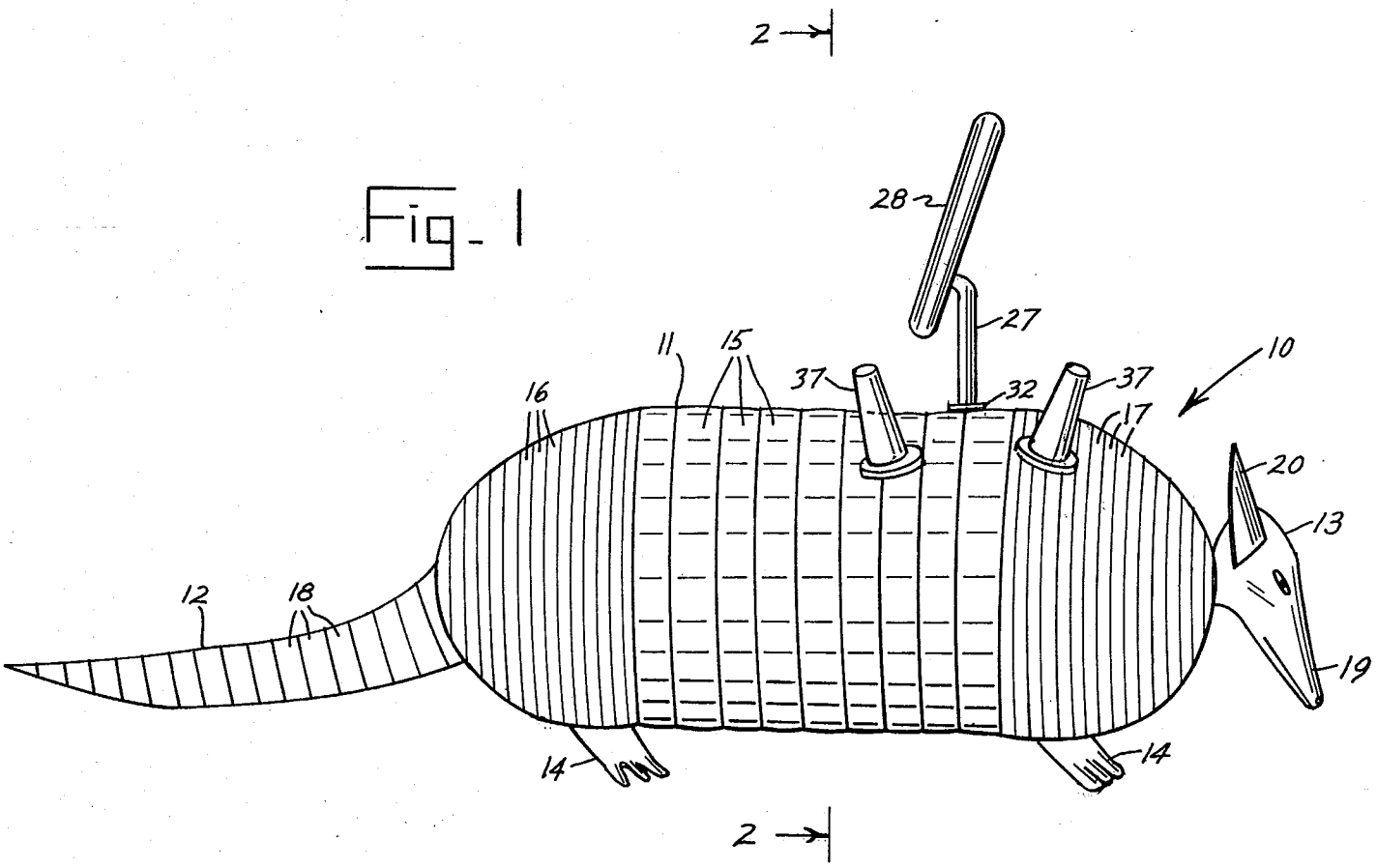
FIG. 1 is a side elevation of a toy of preferred form according to the invention.

Referring now to the drawings in detail, the toy indicated generally by reference numeral 10 includes a body 11 which may be molded of plastic, or otherwise formed of any other suitable material. Body 11 includes an extending tail 12 at one end and an armadillo head 13 at the other end. Body 11 has four unitary feet 14. Two feet 14 are disposed at the front of body 11 and two feet

14 are disposed at the rear of body 11, as is the case for most animals. The body 11 and tail 12 are marked, as in a living armadillo, with circularly disposed stripes, the stripes 15 being wider than the strips 16, 17. In a live armadillo, the stripes 15–17 are provided by jointed plates which serve as armor for the animal. The same is true of the stripes 18 around the tail 12. The head 13 of the armadillo toy has an elongate nose or snout 19 and a pair of upstanding ears 20, only one ear being shown.

Figure 2:
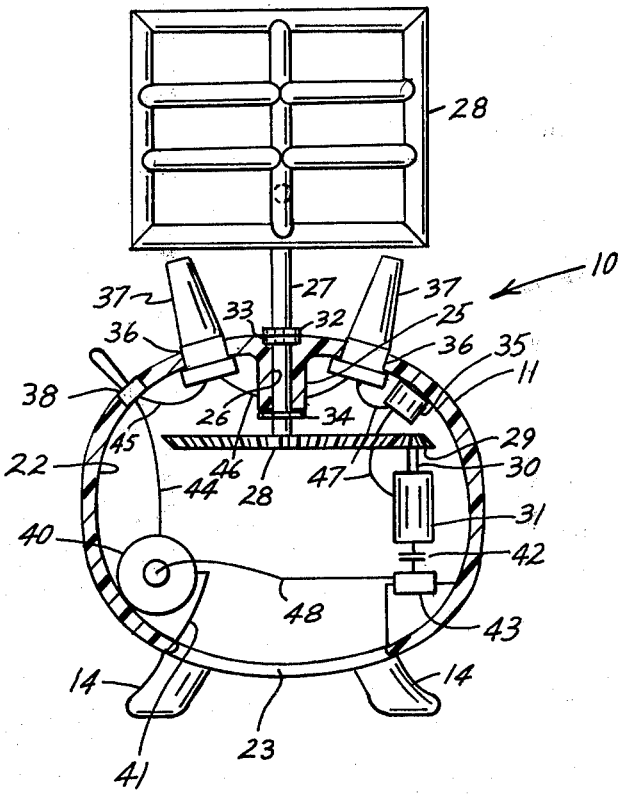
FIG. 2 is a vertical cross section taken at line 2—2 of FIG. 1.

Referring now especially to FIG. 2 of the drawings, body 11 is hollow as at 22. A lower opening 23 provides access into the body cavity 22. A tubular formation 25 provides a passageway 26 for a cylindrical shaft 27 at the upper end of which a rectilinear antenna formation 28 is affixed. A relatively large bevel gear 28 is concentrically affixed to the lower end of shaft 27, and engages a smaller bevel gear 29 which is concentrically carried by shaft 30 of electric motor 31. Gear 28 is larger than 29 so that when motor 31 is operated shaft 27 will be rotated at a slower speed than shaft 30. A collar 32 formed around shaft 27 slidingly engages washer 33 embedded in body 11 and a slidable washer 34 abuts the lower end of tubular formation 25 to retain shaft 27 longitudinally in place. Lamp fixtures 36 are fixed through openings through the wall of body 11 as shown in FIG. 2. Each fixture 36 accepts a blinker light bulb 37 which when energized electrically repeatedly blinks "on" and "off". An on-off switch 38 is affixed through an opening through body 11 so that lights 37 and motor 31 may be turned either "on" or "off". One or more batteries 40 are supported within the cavity 22 of body 11 by a suitable bracket 41. Batteries 40, switch 38, fixtures 36, motor 31, buzzer 35, a capacitor 42 and a LED flasher oscillator 43 are connected in series as indicated by electrical current conductors 44–48. When switch 38 is closed, current from batteries 40 flows through conductors 44–48 to cause illumination of lights 37, operation of buzzer 35, and operation of motor 31 whereby lights 37 flash "on" and "off" continuously, buzzer 35 sounds, and antenna formation 28 rotates with shaft 27. The lights 37 of which there are four arranged in a circular pattern about shaft 27, may be colored the same or differently in order to create special effects.

The rotating antenna 28 and flashing lights 37 are intended to suggest to children the operation of a radar device, and to incite interest of adults. It is contemplated that the unique combination of a buzzer, flashing lights, and rotating antenna on an animal toy having the present-day interest of the armadillo caused by the brewery promotions, will be interesting and useful to young and old alike, and may become very popular.

While a preferred embodiment of the apparatus has been described and shown in the drawings, many modifications thereof may be made by those skilled in the art without departing from the spirit of the invention, and it is intended to protect by Letters Patent all forms of the invention falling within the scope of the following claims.

We claim:

1. Toy, comprising, in combination, a unitary body having the outward form of an armadillo, including a body portion, a tail portion, a head portion, and leg and feet portions, said body portion having a cavity therewithin and having an opening thereinto at the bottom side of said body portion, battery means, electric motor means, capacitor means, buzzer means, flasher oscillator means, plural lamp means, and switch means connected in series in a loop circuit, said electric motor means having a rotating shaft carrying a bevel gear, simulated antenna means mounted at the outer end of a shaft rotatably disposed through the wall of said body portion and having a bevel gear carried on its inner end within said cavity and engaged with said first-named bevel gear, said lamp means being disposed in equally spaced circular dispositions about said antenna shaft, said switch means being accessible from the exterior of said body portion, whereby said switch means may be turned "on" to cause simultaneous sounding of said buzzer means, rotations of said simulated antenna and flashing of said lamps and may be turned "off" to terminate said buzzer sounding, simulated antenna rotation, and flashing of said lamps.

2. The combination of claim 1, there being four said lamp means.

3. The combination of claim 1, said lamp means being flasher lamps which operate with alternating "on" and "off" periods.

* * * * *